United States Patent [19]

Doane et al.

[11] 4,135,425

[45] Jan. 23, 1979

[54] ENVELOPE GENERATOR FOR ELECTRONIC ORGAN

[75] Inventors: Patrick K. Doane; David R. Springston, both of Jasper, Ind.

[73] Assignee: Kimball International, Inc., Jasper, Ind.

[21] Appl. No.: 788,884

[22] Filed: Apr. 19, 1977

[51] Int. Cl.[2] ..... G10H 1/00

[52] U.S. Cl. ..... 84/1.13; 84/1.26; 84/DIG. 8

[58] Field of Search ..... 84/1.13, 1.26, DIG. 8

[56] References Cited

U.S. PATENT DOCUMENTS

| | | | |
|---|---|---|---|
| 3,543,281 | 11/1970 | Brand et al. | 84/1.13 X |
| 3,694,561 | 9/1972 | Morez | 84/1.13 |

*Primary Examiner*—Robert K. Schaefer
*Assistant Examiner*—Leonard W. Pojunas, Jr.
*Attorney, Agent, or Firm*—Albert L. Jeffers; John F. Hoffman

[57] ABSTRACT

An envelope generator for an electronic organ, especially for developing percussion sounds, in which each of at least some of the organ cases having keyers pertaining thereto are provided with envelope control circuits interposed between the keys and the respective keyers. Each envelope control circuit includes voltage supply means connected to the keyer and a control circuit therefor which is actuated by depression of the key. The control circuit provides for continuous actuation of the keyer by voltage from the voltage supply means while the key is depressed or for a momentary supply of keyer actuating voltage from the voltage supply means to the keyer followed immediately by a decay of the keyer actuating voltage at a predetermined rate and which rate can be selectively varied.

7 Claims, 2 Drawing Figures

ENVELOPE GENERATOR FOR ELECTRONIC ORGAN

BACKGROUND OF THE INVENTION

The present invention relates to an envelope generator for use in the keyer circuitry of an electronic organ for imparting predetermined envelope configuration to the sounds produced by the organ upon depression of a key.

Electronic organs are, of course, well known and have as a general objective the provision of music which, in many cases, simulates the sound of known instruments. Among the instruments, the sound of which it is desired substantially to duplicate in an electronic organ, are percussion type instruments, such as piano, harpsichord, banjo, glockenspiel, xylophone and the like. Such organs usually use voltage sensitive keyers to control the passage of tone signals and control the voltage supply to the keyers to impart a desired envelope to the tones controlled by the keyers. In the case of percussion instruments, a fast attack and controlled decay are desired for a sounded tone.

Heretofore, it has not been a simple matter to arrive at a suitable control system for controlling the actuating voltage supplied to a keyer to obtain realistic simulations of instruments referred to above, and to obtain flexibility of control.

The present invention has as a particular object the provision of a circuit for developing keyer control voltages which will effect control of the keyer in such a manner as to simulate the sounds of the nature referred to and in a relatively simple and inexpensive manner.

Another object is the provision of a circuitry for supplying keyer voltage to a keyer, or keyers, in electronic organs in which the voltage supplied to the keyer is selectively operable to control the voltage supply to the keyer so as to produce percussion sounds which will die away at a determined note and go off, or which can control the keyer voltage so as to maintain a keyed note as long as the respective key is depressed.

SUMMARY OF THE INVENTION

The circuit of the present invention is particularly adapted for incorporation in electronic organs in which the keyboard, or keyboards, of the organ is scanned to develop a data stream in which signals corresponding to the respective keys appear in respective time slots. This data stream is then supplied to a demultiplexer which assigns signals corresponding to each depressed key to the proper keyer or keyers for the tone pertaining to the depressed key.

According to the present invention, a depressed key will supply a signal to the demultiplexer which will result in the enabling of a respective keyer circuit. Enabling of the circuit will initiate the development in the circuit of the keyer actuating voltage and will, furthermore, control the keyer voltage via transient circuits and the like to control the keyer actuating voltage and, thereby, the keyer output to obtain a desired envelope for the tone controlled by the keyer.

BRIEF DESCRIPTION OF THE DRAWINGS

The exact nature of the present invention and the objects and advantages thereof will become more apparent upon reference to the following detailed specification taken in connection with the accompanying drawings, in which.

DETAILED DESCRIPTION OF THE INVENTION

Figures 1, 2:
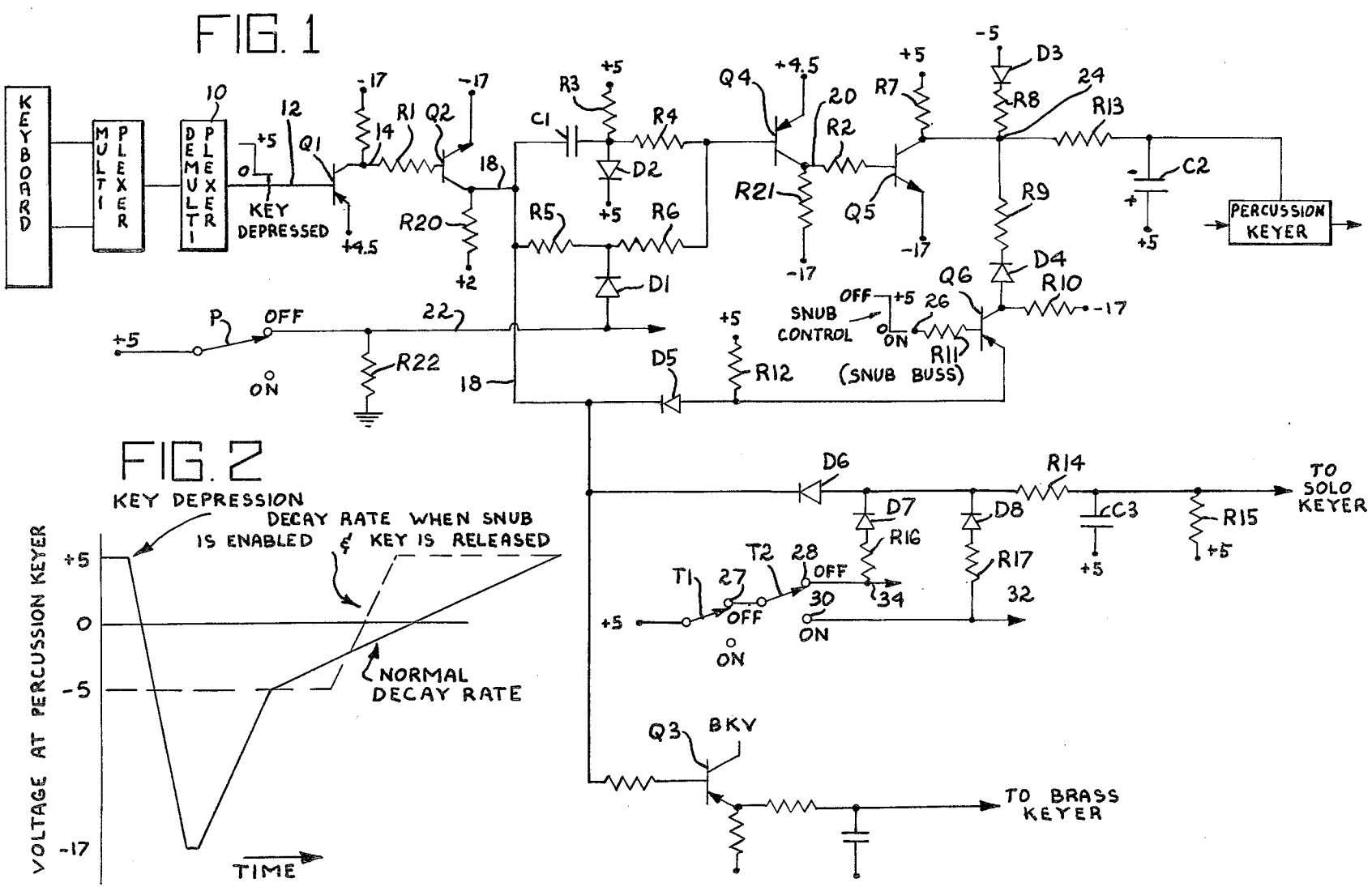
FIG. 1 schematically shows the circuit of the present invention.
FIG. 2 is a graph showing the change in the voltage supplied to a keyer under certain conditions of operation of the circuit.

In the drawings, the block marked 10 is a conventional organ demultiplexer and the circuitry rightwardly of the demultiplexer 10 is the keyer circuitry pertaining to a single key. As is known, the demultiplexer is supplied with a data stream obtained by scanning the organ keyboard and comprising time displaced signals each corresponding to a respective key. The signals are high or low depending on whether or not the key is depressed at the instant of scanning.

The keyer circuitry is the envelope generator and there may be provided one such circuit for every key of the organ, or there may be an envelope circuit of the nature illustrated for only certain ones of the organ keys. The description herein is for a single circuit.

The demultiplexer 10, when the key pertaining to the associated envelope circuit is depressed, drives wire 12 to zero, thereby causing transistor Q1 to go to conduction and thereby supplying a positive signal via wire 14 and resistor R1 to the base of the transistor Q2, whereby this transistor also goes to conduction and pulls wire 18 to minus seventeen volts.

Wire 18 is connected to the collector of transistor Q2 and is also connected to a plus two volt source via resistor R20. The emitter of transistor Q2 is connected to a minus seventeen volt source.

The wire 18, it will be noted, has two steady state voltage conditions with one thereof, namely, when transistor Q2 is conductive, being the condition in which the envelope control circuit of the present invention is enabled. Wire 18 can, thus, be referred to as the input to the circuit.

Wire 18 is connected via a first branch containing an 0.1 microfarad condenser C1 and a 150 K ohm resistor R4 to the base of a transistor Q4. A second branch in parallel with the first branch contains resistors R5 and R6 in series.

When input wire 18 goes negative, transistor Q4 goes to conduction which, in turn, causes wire 20 to go positive and, via resistor R2, to bias transistor Q5 to conduction. The emitter of transistor Q4 is connected to a plus four and one-half volt source while the collector is connected to one end of resistor R2 and to a minus seventeen volt source via a resistor R21.

It will be noted that a plus five volts source is connected via a one megohm resistor R3 to the juncture of capacitor C1 and resistor R4. The said juncture point is also being connected to a plus five source via a diode D2 poled toward the last-mentioned source. Diode D2 can be referred to as a reset diode.

Furthermore, a percussion mode switch P having a blade connected to a source of plus five volts has a first "ON" position in which the blade is disconnected from a buss 22 and a second "OFF" position in which the blade is connected to buss 22. Buss 22 is connected through a diode D1 poled away from the buss to a point which is the juncture of the pair of 100K resistors R5 and R6 which form the above referred to second branch connecting wire 18 to the base of Q4. Buss 22 is grounded via resistor R22.

The aforementioned percussion switch P is in the form of an external tab switch and is turned "ON" and "OFF" by the organ player. Buss 22 represents a buss for several, or all, of the circuits pertaining to others of the keys, as indicated on the drawing, and is connected to the positive side of the diode corresponding to diode D1 of the others of the circuits according to the present invention.

It will be noted that that part of wire 18 having capacitor C1 and resistor R4 therein forms a circuit in which a transient current only will flow while resistors R5 and R6 form a bypass therefor which can be effective when switch P is in the "ON" position thereof.

Following transistor Q4 is a transistor Q5, the collector of which is connected to plus five volt source via a 680K resistor R7, while the emitter of the transistor is connected to a minus seventeen volt source. The collector of transistor Q5 is also connected to a junction point 24, which may be referred to as the output of the circuit, and is connected to a minus five volt source via a 10K resistor R8 and a diode D3 poled away from the minus five volt source.

Juncture point 24 is connected through a 22K resistor R9 and a diode D4 with the collector of a transistor Q6 with the diode D4 poled away from the collector. The collector is also connected through 470K resistor R10 with a minus seventeen volt source, while the base of the transistor Q5 is connected through a resistor R11 with a point 26 which can be held at zero or at plus five volts, selectively under the control of the player.

Transistor Q6 and the associated circuitry form a snub arrangement, to be described hereinafter, and when point 26 is at zero (Q6 conductive) the snub effect is effective and when point 26 is at plus five volts (Q6 nonconductive) the snub effect is turned off.

The emitter of transistor Q6 is connected via a diode D5 poled away from the emitter with the aforementioned wire 18 that is connected to the collector of transistor Q2. Between the emitter of transistor Q6 and diode D5, there is a connection via a 47K resistor R12 with a plus five volt source.

Point 24, previously referred to, is also connected through a 1.5K resistor R13 to the percussion keyer. The percussion keyer side of resistor R13 is also connected to plus five volts through a ten microfarad electrolytic capacitor C2.

As will be seen in the drawings, transistors Q1, Q4 and Q6 are all PNP transistors, while transistors Q2 and Q5 are NPN transistors.

The circuitry is also adapted for connection to a conventional solo keyer by connecting wire 18 through a diode D6 poled toward wire 18 and a 47K resistor R14 to the solo keyer. Between resistor R14 and the solo keyer a 0.22 microfarad capacitor C3 connects the solo keyer to a plus five volts and in parallel therewith is a ten megohm resistor R15.

Sustain is provided for the solo keyer and this can take the form of a switch blade or tab T1, which is connected to a five volt source and which is moved into engagement with a terminal 27 to turn the sustain feature "OFF" and is disconnected from terminal 27 to turn the sustain feature "ON". A second switch or tab T2 is provided which is in the form of a blade connected to terminal 27 having one position of engagement with one terminal 28 and another position of engagement with a second terminal 30.

Terminal 28 is connected through a 47K resistor R16 and a diode D7 poled away from the resistor with the positive side of the aforementioned diode D6. Terminal 30 is connected with a buss 32 leading to all other sustain controls and is also connected through 470K resistor R17 and a diode D8 poled away from the resistor with the positive side of diode D6.

When blade T1 engages terminal 27 sustain is "ON" and when blade T2 engages terminal 28, the sustain is short and when engaging terminal 30, the sustain is long. It will be noted that terminal 28 is connected to a buss 34 leading to all other sustain circuits for the various circuits.

Wire 18, which goes to minus seventeen volts when the circuit is enabled, goes via a resistor to the base of transistor Q3 forming a part of a system which is indicated as being connected to a brass keyer. The brass keyer simulates the sound of brass instruments and in itself forms no part of the present invention. The brass keyer will develop a keyer signal at the output side as long as the pertaining playing key is depressed.

In the circuit arrangement described, envelope generation can be accomplished in a relatively simple manner. With reference to the operation of the system, and in respect, firstly, of the voltage supplied to the solo keyer output line, when a key having a circuit of the nature described associated with the respective keyer is depressed, the solo keyer voltage will change from plus five volts (keyer nonconductive) to minus seventeen volts (keyer conductive) with a relatively rapid time constant and provides a fast attack for the solo keyers. As long as the pertaining key is depressed, the voltage supplied to the solo keyer output line remains at minus seventeen volts, thus driving the corresponding keyer to conduction.

When the respective key is released, the voltage supplied to the solo keyer output line changes from minus seventeen volts to plus five volts according to a time constant that is determined by the characteristics of the sustain circuitry and the settings of the tabs pertaining thereto. This time constant can be quite short or quite long, depending on the capacitors and resistors pertaining to the sustain circuitry.

With respect now to the voltage supplied to the percussion keyer, when the corresponding key is depressed, the percussion keyer voltage will change from plus five to minus seventeen volts relatively quickly, the time constant in respect of this change being under the control of resistor R13 and capacitor C2. This provides for a fast attack, which is necessary for percussion voices. The foregoing occurs when the percussion tab P is in the "ON" position.

If switch P is in the "OFF" position when the key is depressed, the voltage supplied to the percussion keyer will stay at minus seventeen volts following the depression of a key only for a short time, even though the key remains depressed, the time being determined in conformity with capacitor C1 and resistor R4.

The minus seventeen volt signal supplied to the percussion keyer upon depression of the key when the switch P is "OFF", will decay rapidly under the control of resistor R13 and capacitor C2 to minus five volts supplied by diode D3 and resistor R8 to point 24, with the voltage then slowly changing to plus five volts of the control of resistor R7 and R13 and capacitor C2.

The foregoing sequence will take place regardless of the condition of the snub switch previously referred to.

If the snub control voltage is at plus five volts, the above decay sequence will be obtained even if the key is released. However, if the snub control voltage is at zero volts, the decay sequence referred to will be repeated only as long as the key is depressed. If the key is released while the snub control voltage is at zero, the keyer voltage supplied to the percussion keyer will commence a rapid decay to plus five volts.

If the percussion mode tab P is in the "ON" position, which is to say, if wire 22 is at ground potential, diode D1 that normally prevents transistor Q4 from being held on as long as the key is depressed becomes reverse biased. Thus, under these circumstances, the percussion key voltage will go to minus seventeen volts as long as the key is depressed and, as soon as the respective key is released, the voltage supply to the percussion keyer will decay back toward plus five volts with the rate of decay changing at minus five volts depending on whether or not the snub buss is at zero volts or five volts.

The graph of FIG. 2 charts the course of the keyer voltage to the percussion keyers.

The operation of the circuitry may be summarized somewhat as follows:

1. When tab switch P is in the "OFF" position in which it is shown in the drawings, and the snub voltage supplied to terminal 26 is at five volts, the voltage supplied to the keyer will start at plus five volts (keyer nonconductive) and will go to minus seventeen volts when the respective key is depressed and will hold when the respective key remains depressed.

Regardless of whether the respective key is held down or released, the voltage supplied to the percussion keyer will decay rapidly from minus seventeen volts to minus five volts and then will slowly change to plus five volts.

2. When the percussion tab P is in the "OFF" position, as shown in the drawings, and the snub voltage supplied to terminal 26 is zero volts, the output voltage supplied to the respective percussion keyer follows the pattern described in step 1 above as long as the key is depressed. However, if the respective key is released during the decay period, the voltage supplied to the percussion keyer decays to plus five volts quickly.

When the percussion mode is "ON", that is to say, when switch P is moved so that the plus five volts is cut off from wire 22 and this wire, instead, goes to ground, the bypass branch consisting of resistors R5 and R6 becomes effective and the keyer control voltage will stay in minus seventeen volts as long as the respective key remains depressed.

From the foregoing, it will be seen that the circuit arrangement of the present invention provides a supply of keyer voltage such that a respective note will sound when a key is depressed and will, when the circuit is effective for controlling percussive sound, immediately decrease in volume, first, rapidly and then more slowly to an "OFF" condition.

In addition to the above described arrangement for imparting a certain envelope to the tone, the snub voltage supply, previously referred to, can be provided to cause the sound to decrease extremely rapidly when the respective key is released. This snub feature, as mentioned, can either be made effective or ineffective.

Still further, the percussion type sound can be eliminated, or bypassed, under the control of tab switch P, as previously referred to.

It will be appreciated that the circuit according to the present invention can be considered to have an input end (wire 18) which has two steady state voltage conditions depending on whether the respective key is depressed or released. The circuit has an output connected to the keyer control terminal and associated with the output is a variable voltage source. The variable voltage source is under the control of voltage sensitive elements (Q4 and Q5).

The circuitry, furthermore, comprises a connection from the input to the voltage sensitive elements from the variable voltage source which is selectively adjustable for supplying an actuating pulse to the voltage sensitive means (C1, R4) or for conveying the steady state voltage condition from the input to the voltage sensitive means (R5, R6).

The circuit, furthermore, comprises a selector in the form of selector switch P for making the branch R5, R6 ineffective in respect of transmitting a signal to the voltage sensitive means controlling the variable voltage source.

Finally, the variable voltage source includes components which control the decay of the voltage supplied for keyer actuation and means for varying the rate of decay, which last mentioned means is under the control of transistor Q6.

Modifications may be made within the scope of the appended claims.

What is claimed is:

1. An electric organ in which a depressable playing key corresponding to a predetermined note controls a voltage sensitive keyer for the note via an envelope control circuit, said circuit comprising an input which goes to a steady state voltage when the key is depressed, said circuit including an output, a first resistor connecting said output to the keyer and a capacitor connecting the keyer to a source of voltage, variable voltage supply means connected to said output and having a control terminal, and circuit means connecting said input to said control terminal and operable upon the initiation of said steady state voltage at said input to supply a voltage signal to said control terminal to establish a supply of keyer actuating voltage at said output, said circuit means comprising selector means including a switch having a first position in which said voltage signal remains constant as long as the key remains depressed and a second position in which the said voltage signal is in the form of a pulse to cause the keyer actuating voltage at said output to commence to decay immediately after establishing thereon.

2. An electric organ according to claim 1 in which said circuit means comprises a first branch having a capacitor therein and a second branch in parallel with the first branch, said selector switch in said first position making said second branch effective for bypassing said first branch and in said second position making said second branch ineffective for bypassing said first branch.

3. An electric organ according to claim 1 in which said circuit means comprises a first branch having a second capacitor and a second resistor connected together at a juncture in the order named between said input and said control terminal and a second branch in parallel with the first branch having third and fourth resistors in series, said selector including a diode having one side connected to the juncture of said third and fourth resistors and the other side connected to a terminal which is grounded via a resistor, said switch adapted selectively to connect a voltage source to said terminal.

4. An electric organ according to claim 3 which includes a reset diode connected between the juncture of said second capacitor and second resistor and a source of voltage.

5. An electric organ according to claim 1 in which said voltage supply means includes an NPN transistor having a collector and an emitter and a base and having a first source of keyer deactivating voltage connected to said collector via a smaller fifth resistor and a second source of maximum keyer activating voltage connected to said emitter and a third source of voltage having a value intermediate that of said first and second sources connected via a larger sixth resistor to said collector, said circuit means being connected to the base of said transistor.

6. An electric organ according to claim 5 which includes rate of voltage decay controlling snub means selectively operable for connecting said first source to said output via a resistor having a value substantially less than that of said smaller resistor.

7. An electric organ according to claim 6 wherein said last mentioned resistor is connected between said first source and said output with one end of said resistor being electrically closer to said first source than its opposite end, and in which the end of said last mentioned resistor opposite said first source is connected to said input via diode means for making said snub means ineffective while the key is depressed.

* * * * *